US005617888A

United States Patent [19]

Wu

[11] Patent Number: 5,617,888

[45] Date of Patent: Apr. 8, 1997

[54] GARDEN UMBRELLA WITH SPECIALLY DRILLED PULLEY CORD GUIDE AND RETAINER MEANS IN WOOD POLE FOR MAINTAINING PULLEY CORD

[76] Inventor: Nick Wu, 12685 Prescott Ave., Tustin, Calif. 92780

[21] Appl. No.: 667,022

[22] Filed: Jun. 20, 1996

[51] Int. Cl.[6] ..... A45B 11/00

[52] U.S. Cl. ..... 135/20.3; 135/254; 144/136.1; 144/136.7

[58] Field of Search ..... 135/20.3, 20.1, 135/15.1, 114, 25.41, 19; 52/222; 144/136.1, 136.7, 136.95; 403/297

[56] References Cited

U.S. PATENT DOCUMENTS

| | | | |
|---|---|---|---|
| 3,150,671 | 9/1964 | Frey | 135/20.3 |
| 3,171,418 | 3/1965 | Meyer | 135/25.4 X |
| 3,643,713 | 2/1972 | Massetani | 144/136.1 X |
| 3,692,075 | 9/1972 | White | 144/136.1 |
| 3,774,661 | 11/1973 | Duong Vinh | 144/136.1 X |
| 4,697,606 | 10/1987 | Ma | 135/20.3 |
| 4,859,109 | 8/1989 | Targetti | 403/297 |
| 4,993,445 | 2/1991 | Dubinsky | 135/20.3 |
| 5,018,921 | 5/1991 | Pinney | 403/297 X |
| 5,029,596 | 7/1991 | Tung | 135/20.3 |
| 5,209,599 | 5/1993 | Kronenberg | 403/297 X |

*Primary Examiner*—Lanna Mai
*Attorney, Agent, or Firm*—Philip Young, Esq.

[57] ABSTRACT

A garden umbrella of the solid wood pole type is designed to accommodate the pulley cord within a specially drilled cord passage located adjacent to a narrow neck slot extending longitudinally between the pulley, located at the top of the pole, and the hand crank near the bottom of the pole. A special drill bit is designed with both (a) narrow neck cutting edges for drilling the narrow neck slot and (b) relatively large main head cutting edges for drilling the cord passage in one simple manufacturing operation. The cord passage is sized to accommodate the pulley cord for up and down movement therein while the narrow neck slot is smaller than the cord thickness, thereby preventing the pulley cord from passing out of the pole through such narrow neck slot.

9 Claims, 3 Drawing Sheets

FIG. 3A
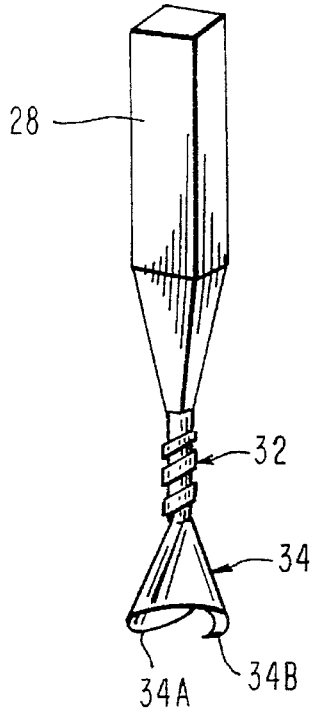
FIG. 3B
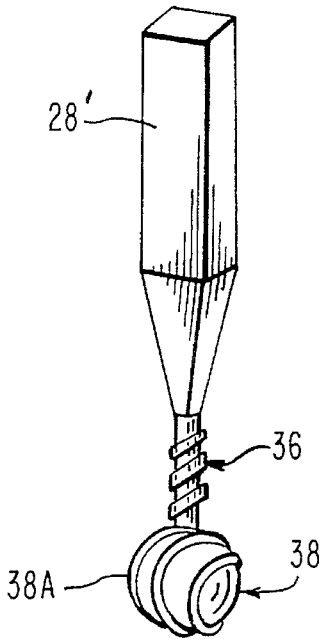
FIG. 4
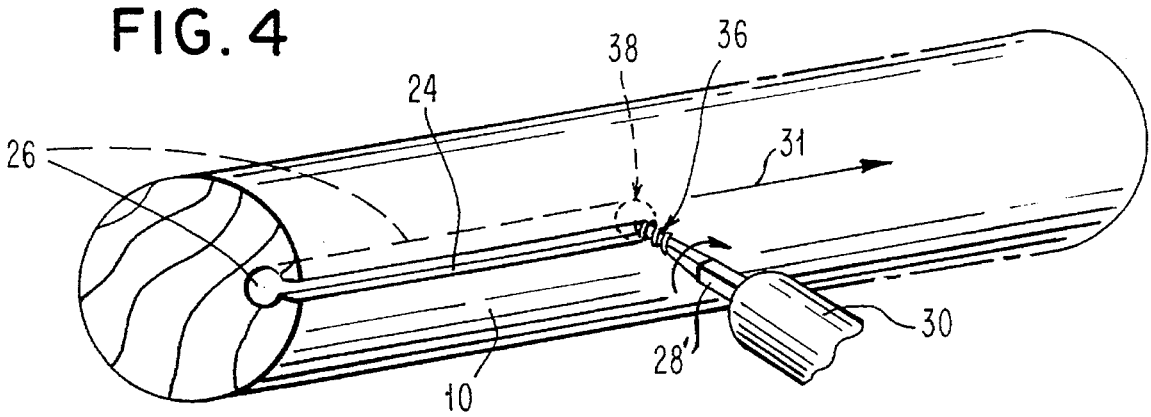
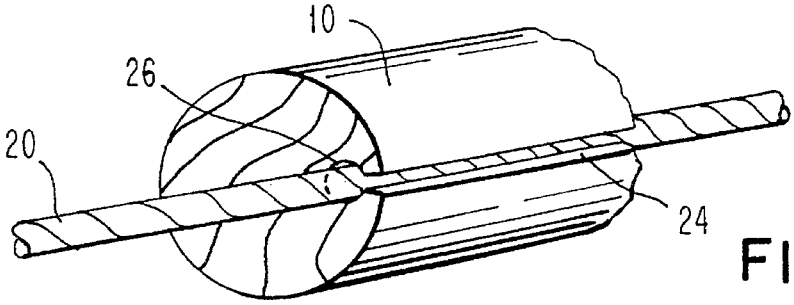
FIG. 5

GARDEN UMBRELLA WITH SPECIALLY DRILLED PULLEY CORD GUIDE AND RETAINER MEANS IN WOOD POLE FOR MAINTAINING PULLEY CORD

FIELD OF THE INVENTION

The present invention relates to garden umbrellas and, more particularly, to garden umbrellas of the type employing a hand crank and pulley cord passing through a wood umbrella pole.

BACKGROUND ART

Garden umbrellas employing solid wood poles are widely used due to both their structural strength and their aesthetic appearance of the wood pole and, in most cases, the wood canopy ribs and the connecting support ribs. One type of market umbrella is disclosed by Emanuel Dubinsky in U.S. Pat. No. 4,567,907 issued on Feb. 4, 1986 wherein a pulley wheel is mounted at the top of the wood umbrella pole while a pulley cord is attached at one end to a ribholder for raising and lowering the ribholder and opening and closing the umbrella canopy in response to the operator's action on the pulley cord. In such patent, the pulley cord is attached at its other end to a handle which is grasped and pulled by the operator. Here, the pulley cord is located outside of the wood pole and is, therefore, exposed to view.

Another type of market umbrella using a generally solid wood pole is disclosed by Emanuel Dubinsky in U.S. Pat. No. 4,993,445 issued on Feb. 19, 1991 wherein a hand crank and pulley cord arrangement opens and closes the umbrella canopy using a pulley cord which passes through a narrow channel groove formed longitudinally along the side of the wood pole. Here, the pulley cord is described as being contained in the channel groove by providing a wall member comprised of a retaining means in the form of a plastic tube or bead, a snap-in strip, a filler material or a plastic tubing surrounding the wood pole.

SUMMARY OF THE INVENTION

In view of the above, it is an object of the present invention to provide a garden umbrella of the type employing a wood pole and a hand crank and pulley cord wherein the pulley cord guide and retainer for the cord in the wood pole are produced in one simple operation. It is another object of the present invention to provide a garden umbrella of the type employing a wood pole and a hand crank and pulley cord wherein the pulley cord guide and retainer for the cord in the wood pole are inexpensive to produce.

These and other objects are achieved by the present invention which provides a garden umbrella, of the solid wood pole type, designed to accommodate a pulley cord within a specially drilled cord passage located adjacent to a narrow neck slot extending longitudinally in the pole between the pulley, located at the top of the pole, and the hand crank near the bottom of the pole. A special drill bit is designed with both (a) narrow neck cutting edges for drilling the narrow neck slot and (b) relatively large main head cutting edges for drilling the cord passage in one simple manufacturing operation. The cord passage is sized to accommodate the pulley cord for up and down movement therein while the narrow neck slot is made smaller than the cord thickness, thereby preventing the pulley cord from passing out of the pole through such narrow neck slot.

BRIEF DESCRIPTION OF THE DRAWINGS

FIG. 3A is a perspective view of a drill bit designed with the special narrow neck cutting edges for drilling the narrow neck slot as well as main head cutting edges for drilling a triangular shaped cord passage of the general cross section shown in FIGS. 6B and 6C;

FIG. 3B is a perspective view of a drill bit designed with the special narrow neck cutting edges for drilling the narrow neck slot as well as main head cutting edges for drilling a circular, oval or elliptical shaped cord passage of the general cross section shown in FIGS. 6A, 6E and 6F;

FIG. 4 is a perspective side view of the wood pole and the drill during the manufacturing operation with the drill bit cutting out the cord passage and the narrow neck slit in a one step procedure;

FIG. 5 shows a section of the umbrella pole with the umbrella cord extending through the cord passage and being retained in the narrow neck slot;

DESCRIPTION OF THE PREFERRED EMBODIMENTS

Figure 1:
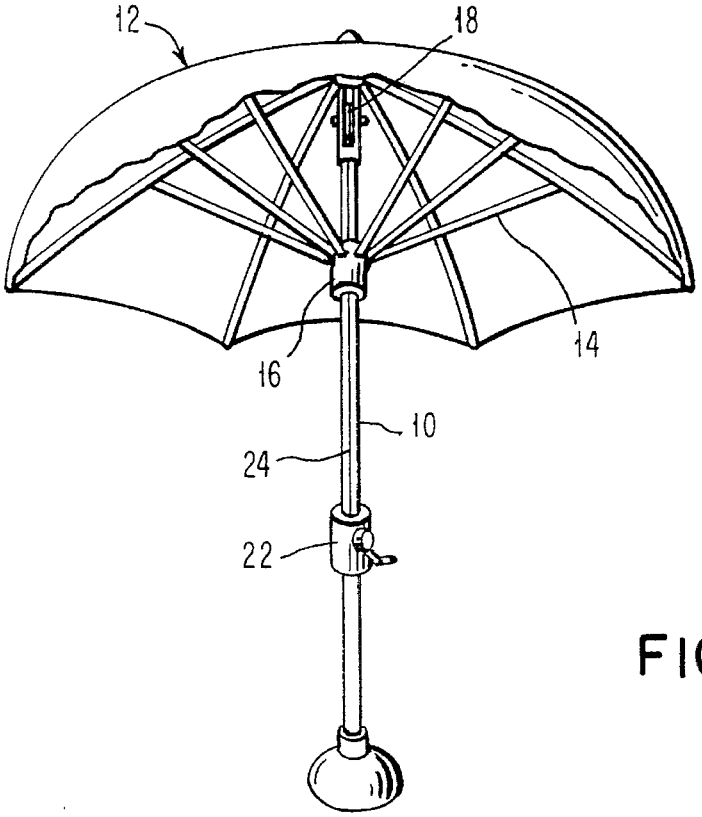
FIG. 1 is a perspective side view, partially broken away, of an umbrella, commonly known as a "market umbrella", employing a wood pole having the cord passage and narrow neck slot, illustrative of the present invention.
Figure 2:
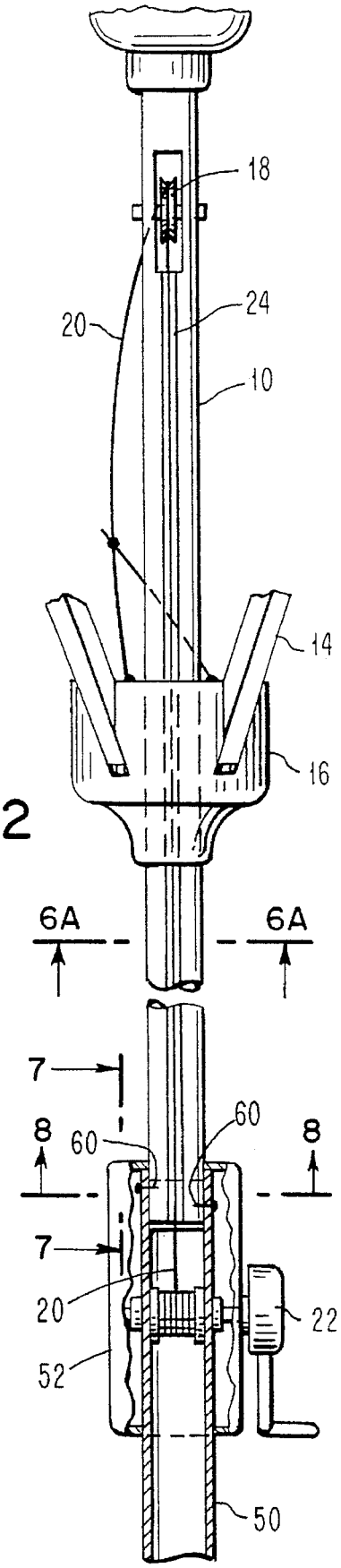
FIG. 2 is an elevation view of the wood umbrella pole extending between the top of the umbrella and the hand crank.

Referring to FIGS. 1 and 2, there is shown an umbrella made according to the present invention including a pole 10, an umbrella canopy 12 supported by both canopy ribs and stretcher ribs 14 being pivotally connected to a rib holder or runner notch 16 which encircles the pole and opens and closes the umbrella as such runner notch 16 slides up and down between a pulley wheel 18 and mechanism at the top of pole 10 and a hand crank 22 at the bottom of pole 10. As shown in more detail in FIG. 2, a pulley cord 20 is tied to or otherwise connected at one end to the runner notch 14, after which the cord 20 extends up to the top of the pole where it operatively engages with the pulley wheel 18. The cord 20 then extends through a passage 26 formed in the pole 10 according to the present invention, the details of which are provided below. The cord 20 extends out of the bottom of passage 26 and pole 10 where it wraps around the reel of hand crank 22 which operates in the conventional manner to raise and lower the runner notch 16.

Figure 6A:
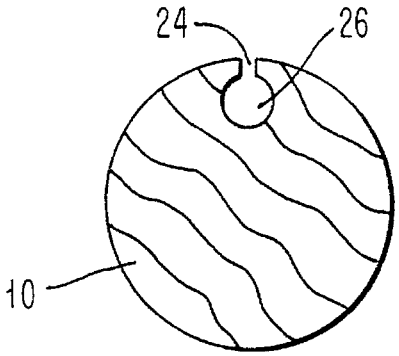
FIGS. 6A through 6F are cross sections of the pole with various shaped cord passages
Figure 6B:
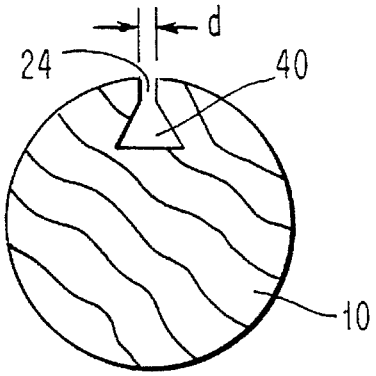
Figure 6C:
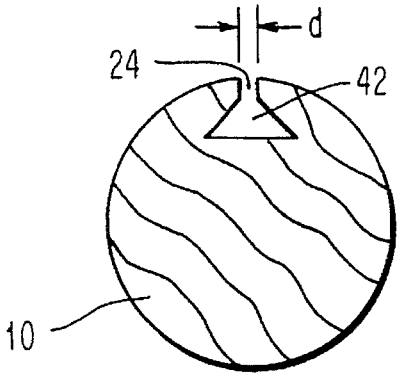

Referring to FIG. 4, the cord passage 26 is located adjacent to and opens into a narrow neck slot 24 formed in the longitudinal direction along the peripheral portion of the pole. The narrow neck slot 24, as shown in FIGS. 4 and 5, is designed to be smaller than the diameter of the cord 20 as well as the cord passage 26, so that the cord 20 is retained in the passage 26 and can not slip out of the passage 26 through the narrow neck slot 24. The size of the opening of the narrow neck slot 24 is indicated in FIGS. 6A, 6B and 6*c* by the dimension "d". The slot dimension d is designed as smaller than the diameter of the cord 20.

Figure 6D:
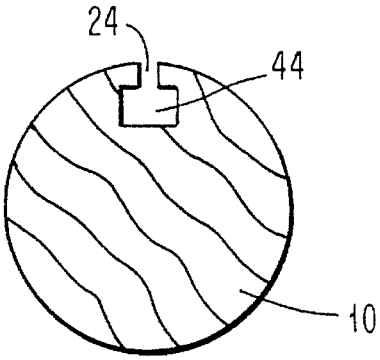
Figure 6E:
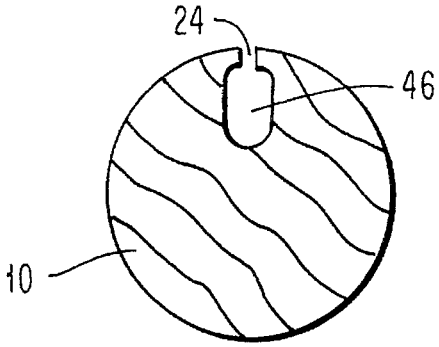
Figure 6F:
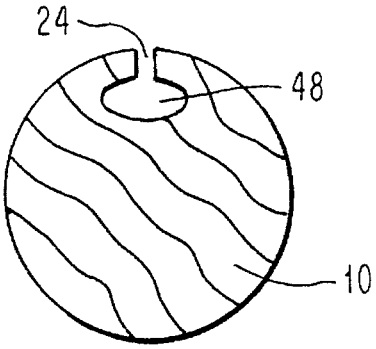

FIGS. 3A and 3B show different drill bits 28 and 28' specially designed for achieving the objects of the present invention. More particularly, the drill bit 28 shown in FIG. 3A comprises narrow neck cutting edges 32 for drilling the narrow neck slot 24 corresponding to the slot dimension d. At the far end of the narrow neck cutting edges 32 there is attached a main drill head 34 including a plurality of main head cutting edges 34A and 34B for drilling a triangular cord passage 26 having the general triangular shaped cross-section of the passages 40 and 42 shown, respectfully, in FIGS. 6B and 6C. According to another embodiment shown in FIG. 3B, the drill bit 28' includes narrow neck cutting edges 36, similar to the cutting edges 32, for drilling the narrow neck slot 24, such cutting edges 36 leading, at their outer end, to main drill head 38 having cutting edges 38A. The cutting edges 38A are designed to form a cord passage 26 having the circular cross-section 26 shown in FIG. 6A, or the elliptical cord passage 46 shown in FIG. 6E, or the oval cord passage 48 shown in FIG. 6F. Also, a square shaped cord passage 44, shown in FIG. 6D, can be formed by a main drill head, not shown.

In the manufacturing operation, as shown in FIG. 4, the cord passage 26 and the narrow neck slot 24 are formed in one simple pass or routing operation of a drill 30 and drill bit 28' along the length of the pole to in the direction shown by the arrow 31. In this fashion, both the cord passage 26 and the narrow neck slot 24 are produced in a simple, efficient and inexpensive manner, without requiring a separate retainer part for holding the cord in the cord passage 26 and without requiring a separate operation for installing a cord retainer along the wood pole 10.

Figure 8:
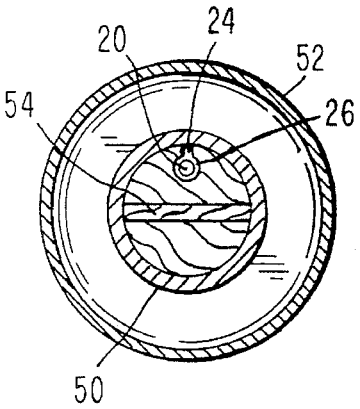
FIG. 8 is a cross section looking up through the handle housing, as depicted by section lines in FIG. 2.
Figure 7:
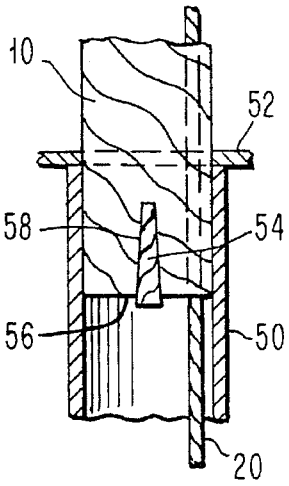
FIG. 7 is a partial longitudinal cross-section of the bottom portion of the wood pole and the top of the crank handle housing, as depicted by section lines in FIG. 2.

FIGS. 7 and 8 show the manner whereby the bottom of the wood pole 10 is joined to the top of a metal tube 50 which is fitted within the housing 52 of the hand crank 22. The bottom of wood pole 10 is secured within the top of the hollow tube 50 by a wood or metal wedge 54 which extends in a slot 58 across the bottom end 56 of the pole 10 and, by means of the wedge action, forces the wood of the pole 10 outward against the inner wall of the tube 50. Nails or screws 60 extend through the tube 50 and into the wood pole 10 for further securing the pole 10 to the tube 50.

While the invention has been described above with respect to its preferred embodiments, it should be understood that other forms and embodiments may be made without departing from the spirit and scope of the present invention.

What is claimed is:

1. In an umbrella having a pole made of a solid rigid material, support ribs pivotally attached to a ribholder connected to said pole for slidable movement therealong, and an umbrella cover attached to said support ribs, a pulley wheel attached near the top of said pole, a hand crank mounted at the bottom of said pole, and a pulley cord attached at one end to said ribholder and at its other end to said hand crank and operatively extending around said pulley wheel for opening said umbrella cover in response to turning said hand crank, the improvement of which comprises:

said solid pole including an external wall, a narrow neck slot formed along said external wall of said pole and extending longitudinally along said pole between said pulley wheel and said hand crank, and a cord passage located adjacent to said narrow neck slot and formed further into said solid pole near said external wall, said cord passage extending longitudinally along said pole between said pulley wheel and said hand crank and being in communication with and opening into said narrow neck slot along said longitudinal length thereof, said cord passage having a relatively larger cross-section area than said narrow neck slot and being of such area size to accommodate said pulley cord for longitudinal movement in said cord passage, and said narrow neck slot having a smaller width than the cross section of said pulley cord thereby preventing said pulley cord from passing out of said pole through said narrow neck slot;

a tube being adapted to receive therein a portion of the bottom of said solid pole in close fitting relationship therein, said solid pole being made of wood, and a means inserted into the bottom of said solid wood pole for forcing the wood outward against an inner wall of said tube and thereby securing said pole to said tube.

2. An umbrella as recited in claim 1, wherein said cord passage opens into said narrow neck slot which has a smaller width formed along said external wall of said pole, said cord passage and said narrow neck slot forming a continuous opening into said external wall of said pole, whereby said cord passage and said narrow neck slot can be formed by a drill bit having narrow neck cutting edges formed along a center of said drill bit, and relatively larger main head cutting edges formed at the end of said drill bit.

3. An umbrella as recited in claim 1, wherein said pole is made of solid wood, said cord passage opens into said narrow neck slot which has a smaller width than the width of said cord passage, said narrow neck slot being formed along said external wall of said pole, said cord passage and said narrow neck slot being formed by as a single drilled slot by passing a drill bit longitudinally along the external wall of said pole, said drill bit having narrow neck cutting edges formed along a center of said drill bit, and relatively larger main head cutting edges formed at the end of said drill bit, thereby forming a continuous opening into said external wall of said pole comprising both said cord passage and said narrow neck slot.

4. An umbrella as recited in claim 1, wherein said cord passage has a general circular cross-section shape and opens into said narrow neck slot which has a smaller width formed along said external wall of said pole.

5. An umbrella as recited in claim 1, wherein said cord passage has a general triangular cross-section.

6. An umbrella as recited in claim 1, wherein said cord passage has a general square cross-section.

7. An umbrella as recited in claim 1, wherein said cord passage has a general oval cross-section.

8. An umbrella as recited in claim 1, further comprising means for attaching said tube to said bottom of said wood pole.

9. In an umbrella having a pole made of a solid wood material, support ribs pivotally attached to a ribholder connected to said pole for slidable movement therealong, and an umbrella cover attached to said support ribs, a pulley wheel attached near the top of said pole, a hand crank mounted at the bottom of said pole, and a pulley cord attached at one end to said ribholder and at its other end to said hand crank and operatively extending around said pulley wheel for opening said umbrella cover in response to turning said hand crank, the improvement of which comprises:

said solid pole including an external wall, a narrow neck slot formed along said external wall of said pole and extending longitudinally along said pole between said pulley wheel and said hand crank, and a cord passage located adjacent to said narrow neck slot and formed further into said solid pole near said external wall, said cord passage extending longitudinally along said pole between said pulley wheel and said hand crank and being in communication with and opening into said narrow neck slot along said longitudinal length thereof, said cord passage having a relatively larger cross-section area than said narrow neck slot and being of such area size to accommodate said pulley cord for longitudinal movement in said cord passage, and said narrow neck slot having a smaller width than the cross section of said pulley cord thereby preventing said pulley cord from passing out of said pole through said narrow neck slot; and a tube being adapted to receive therein a portion of the bottom of said solid pole in close fitting relationship therein, and wedge means inserted into the bottom of said solid wood pole for forcing the wood outward against an inner wall of said tube and thereby securing said pole to said tube.

* * * * *